US010162282B2

(12) United States Patent
Moalem et al.

(10) Patent No.: US 10,162,282 B2
(45) Date of Patent: Dec. 25, 2018

(54) ELECTROSTATIC PRINTING SYSTEM WITH CHARGED VOLTAGE DEPENDENT ON DEVELOPER VOLTAGE

(71) Applicant: HEWLETT-PACKARD INDIGO B.V., Amstelveen (NL)

(72) Inventors: Sasi Moalem, Ness Ziona (IL); Dmitry Maister, Ness Ziona (IL); Yossi Cohen, Rehovot (IL); Kobi Shkuri, Ness Ziona (IL); Michel Assenheimer, Kfar Sava (IL)

(73) Assignee: HP INDIGO B.V., Amstelveen (NL)

( * ) Notice: Subject to any disclaimer, the term of this patent is extended or adjusted under 35 U.S.C. 154(b) by 0 days.

(21) Appl. No.: 15/541,254

(22) PCT Filed: Jan. 29, 2015

(86) PCT No.: PCT/EP2015/051787

§ 371 (c)(1),
(2) Date: Jun. 30, 2017

(87) PCT Pub. No.: WO2016/119849

PCT Pub. Date: Aug. 4, 2016

(65) Prior Publication Data

US 2017/0371266 A1 Dec. 28, 2017

(51) Int. Cl.

| | |
|---|---|
| ***G03G 15/00*** | (2006.01) |
| ***G03G 15/02*** | (2006.01) |
| ***G03G 15/06*** | (2006.01) |

(52) U.S. Cl.

CPC ..... *G03G 15/0266* (2013.01); *G03G 15/065* (2013.01); *G03G 15/80* (2013.01); *G03G 2221/0005* (2013.01)

(58) Field of Classification Search

CPC .. G03G 15/0266; G03G 15/065; G03G 15/80; G03G 2221/0005

(Continued)

(56) References Cited

U.S. PATENT DOCUMENTS

| | | | |
|---|---|---|---|
| 4,432,634 | A | 2/1984 | Tabuchi |
| 5,402,210 | A | 3/1995 | Hart et al. |

(Continued)

FOREIGN PATENT DOCUMENTS

| | | |
|---|---|---|
| DE | 102008030971 | 1/2010 |
| JP | H0312671 | 1/1991 |

(Continued)

OTHER PUBLICATIONS

Wang, et al. "Charging of moving surfaces by corona discharges sustained in air." Journal of Applied Physics 116, No. 4 (2014): 043301.

*Primary Examiner* — Susan S Lee

(74) *Attorney, Agent, or Firm* — HP Inc. Patent Department

(57) ABSTRACT

In one example, an electrostatic printer includes: a photoconductor member; a charging unit to charge the photoconductor member to a charged voltage; an imaging unit to generate a latent electrostatic image on the photoconductor member by discharging areas of the charged photoconductor member; a developer unit to develop a toner image on the photoconductor member using a developer voltage; and a controller to change the developer voltage and to change the charged voltage dependent on the change of the developer voltage to keep the difference between the developer voltage and the charged voltage constant.

16 Claims, 5 Drawing Sheets

(58) Field of Classification Search
USPC ..... 399/89
See application file for complete search history.

(56) References Cited

U.S. PATENT DOCUMENTS

| | | | | |
|---|---|---|---|---|
| 5,832,333 | A | 11/1998 | Umeda et al. | |
| 5,899,596 | A | 5/1999 | Thompson | |
| 2004/0042813 | A1 | 3/2004 | Takai | |
| 2005/0089341 | A1* | 4/2005 | Choi | G03G 15/0208 399/50 |
| 2005/0169671 | A1 | 8/2005 | Kellie et al. | |
| 2005/0238971 | A1 | 10/2005 | Jodra et al. | |

FOREIGN PATENT DOCUMENTS

| | | | | | |
|---|---|---|---|---|---|
| JP | H0883021 | | | 3/1996 | |
| JP | 08297383 | A | * | 11/1996 | |
| JP | 2004170789 | A | * | 6/2004 | G03G 15/0848 |
| JP | 2014142509 | | | 8/2014 | |

* cited by examiner

ELECTROSTATIC PRINTING SYSTEM WITH CHARGED VOLTAGE DEPENDENT ON DEVELOPER VOLTAGE

CROSS-REFERENCE TO RELATED APPLICATION

This application is a U.S. National Stage Application of and claims priority to International Patent Application No. PCT/EP2015/051787, filed on Jan. 29, 2015, and entitled "ELECTROSTATIC PRINTING SYSTEM WITH CHARGED VOLTAGE DEPENDENT ON DEVELOPER VOLTAGE," which is hereby incorporated by reference in its entirety.

BACKGROUND

Many electrostatic printing systems generate a latent electrostatic image on a photoconductor member and develop thereon a toner image that is transferred, either directly or indirectly, to a media. Toner may be transferred electrostatically to the photoconductor member from a developer unit.

Some electrostatic printing systems may use a dry toner powder, whereas other printing systems, such as liquid electro-photographic (LEP) printing systems, may use a liquid toner.

BRIEF DESCRIPTION

Examples will now be described, by way of non-limiting example only, with reference to the accompanying drawings, in which.

Figure 3C:
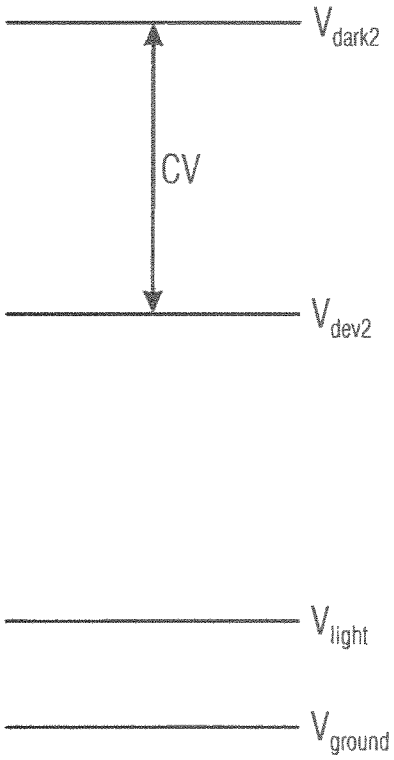
Figure 3B:
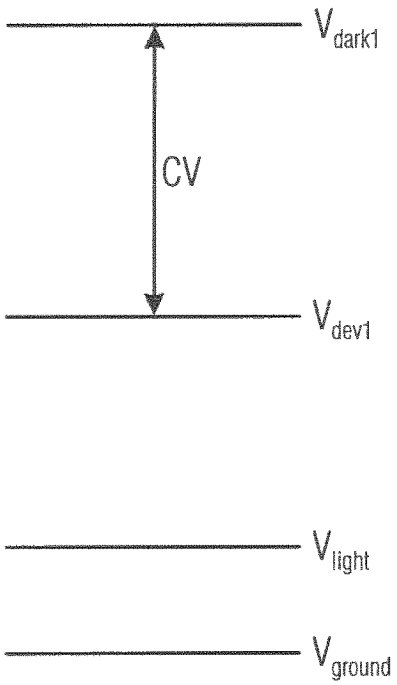
Figure 3A:
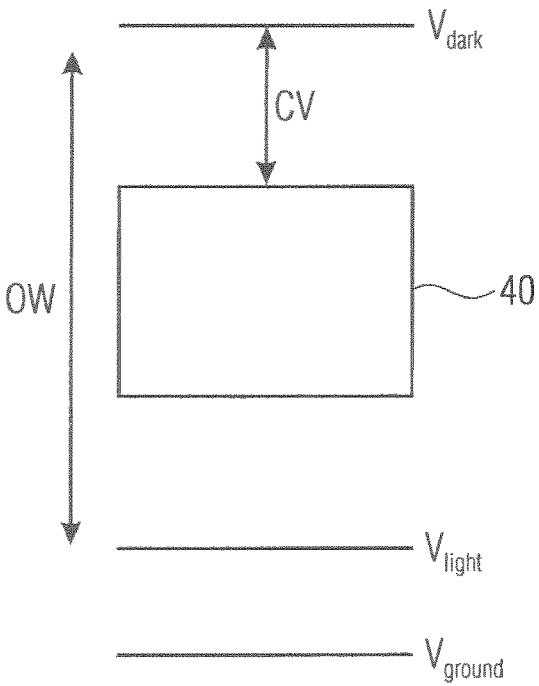
Figure 4:
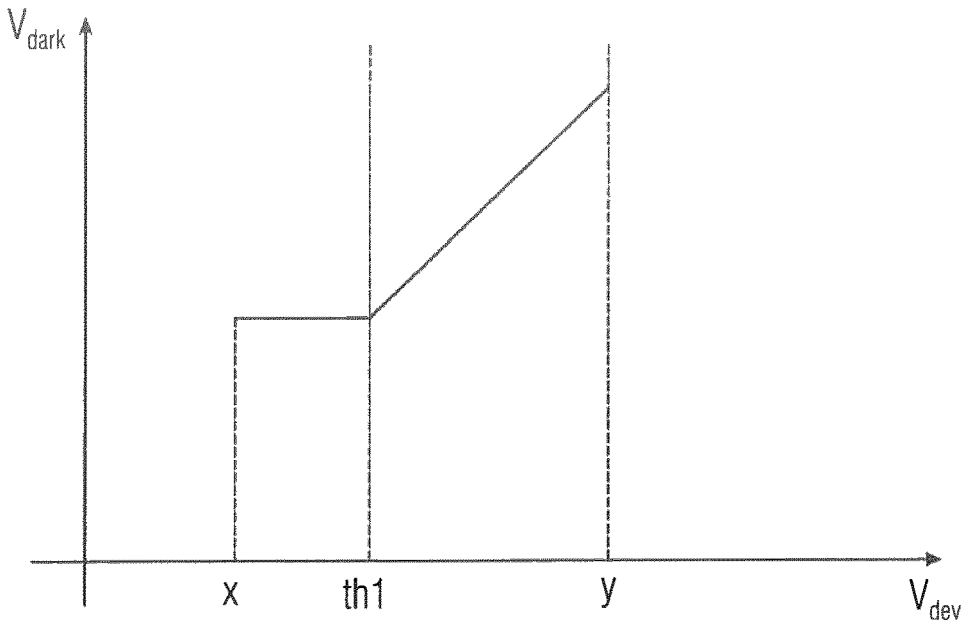
Figure 5:
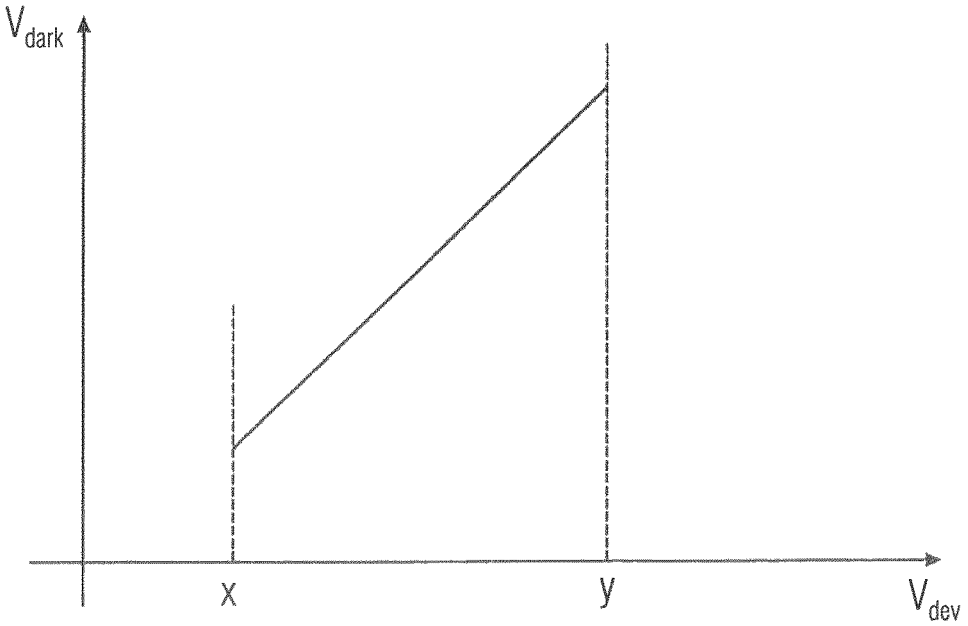
Figure 6:
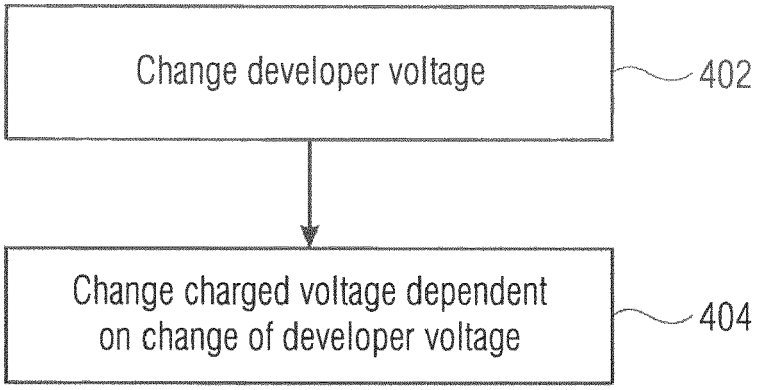
Figure 7:
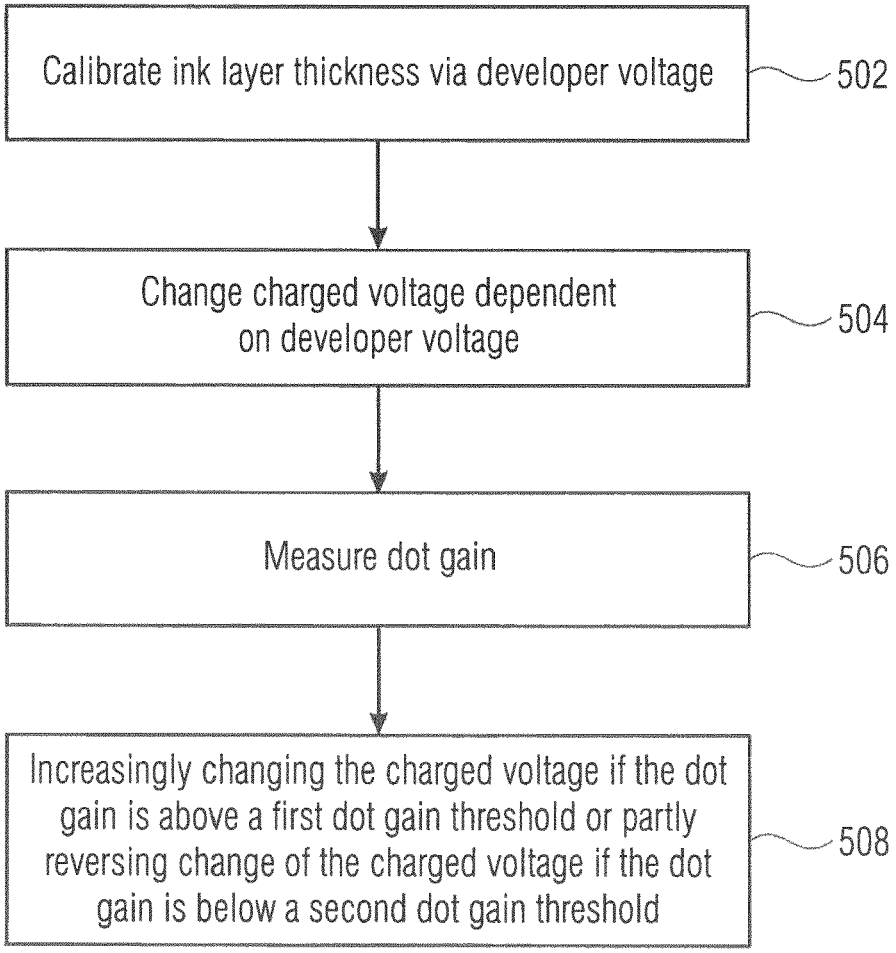
Figure 8:
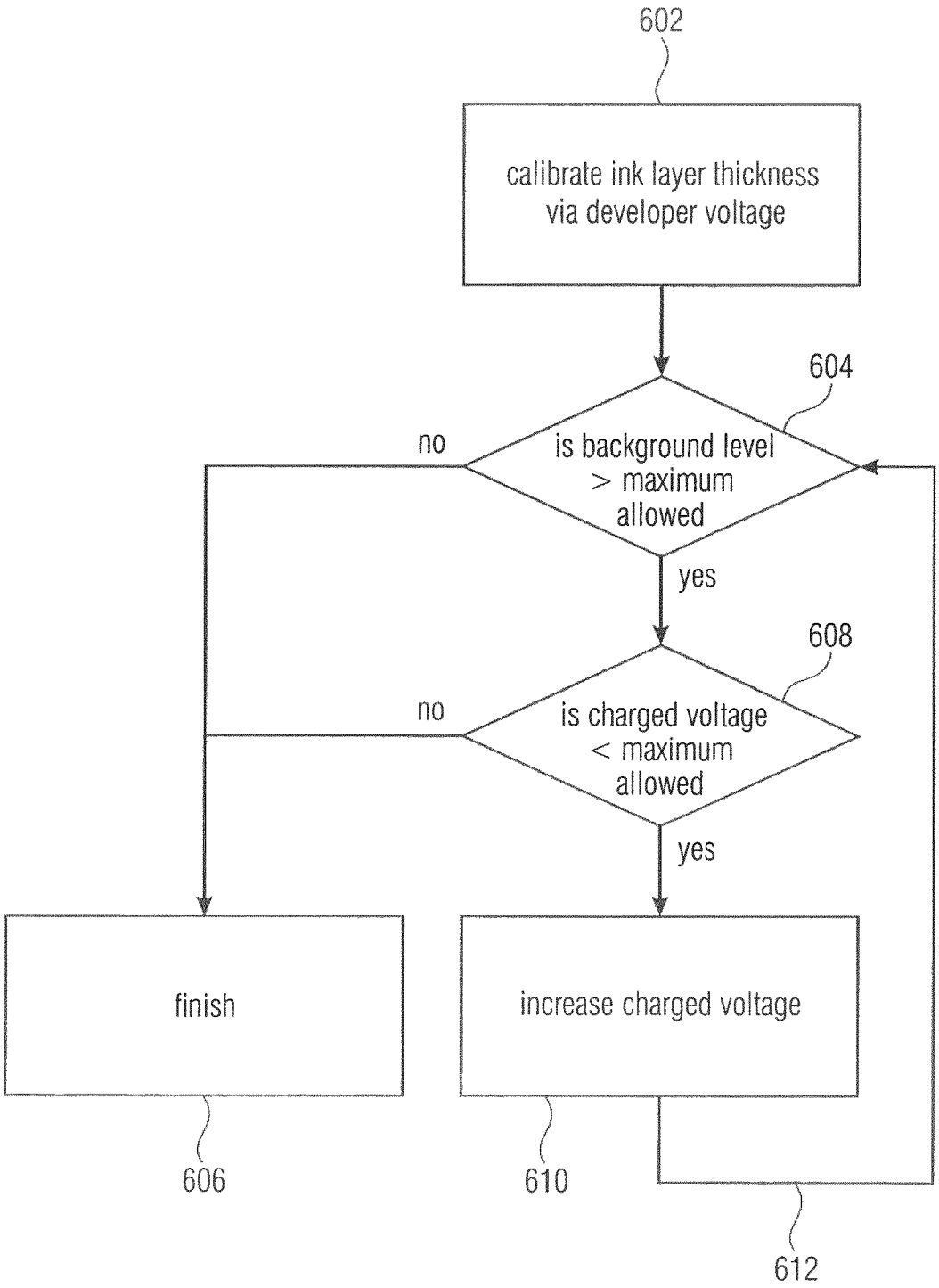

FIGS. 3*a* to 3*c* are schematic diagrams of voltages appearing in an example of a printing system;

FIGS. 4 and 5 examples of functions of changing the charged voltage dependent on the developer voltage FIG. 6 a flow diagram outlining a method of operating a printing system according to one example;

FIG. 7 a flow diagram outlining a method of operating a printing system according to another example; and FIG. 8 a flow diagram outlining a method of operating a printing system according to another example.

DETAILED DESCRIPTION

The examples and description below make reference generally to liquid electro-photographic (LEP) printing systems. Such printing systems electrostatically transfer liquid toner to a photoconductor member for onward transfer to a media. However, the techniques described herein may also apply, with appropriate modifications, to other electrostatic printing systems, such as dry toner printing systems.

Figure 1:
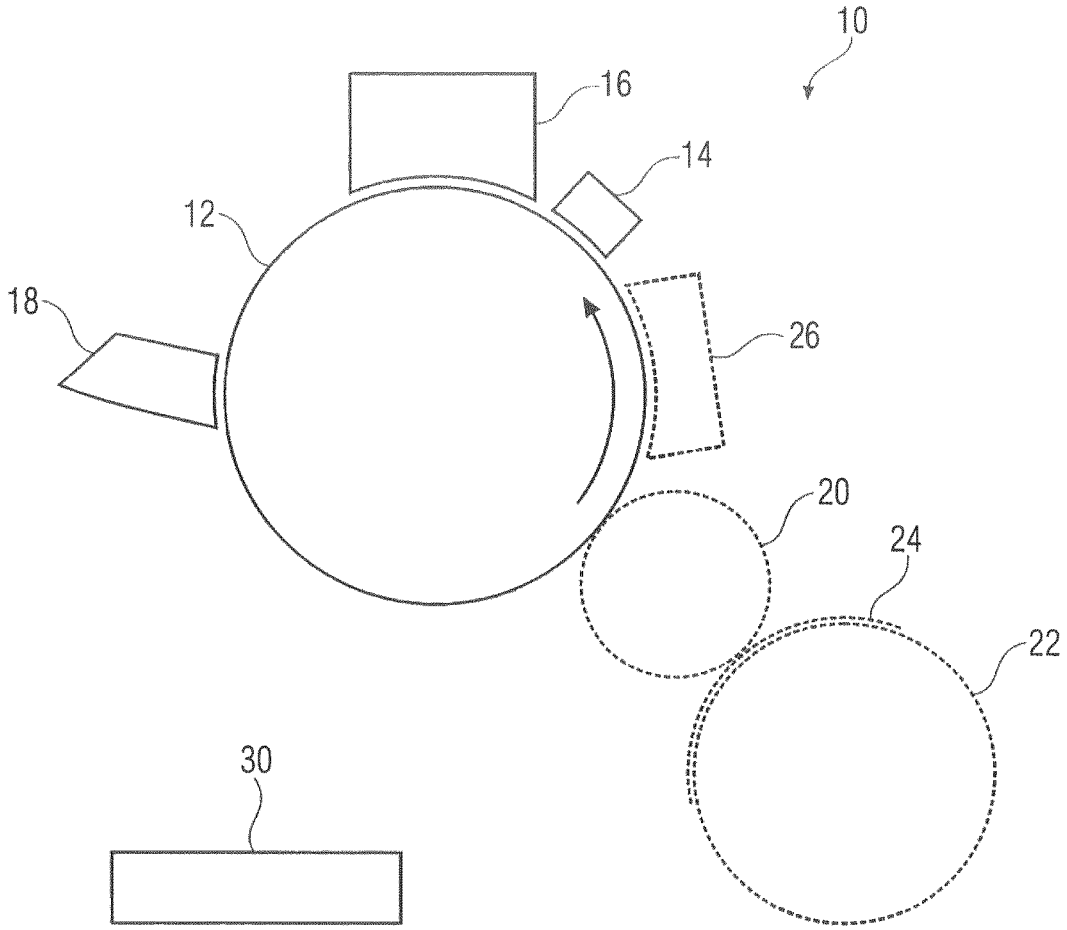
FIG. 1 is a block diagram of a printing system according to one example.

Referring now to FIG. 1 there is shown a simplified illustration is shown of a liquid electro-photographic (LEP) printing system according to one example. The printing system 10 comprises a photoconductor member 12. In the example shown, the photoconductor 12 is in the form of a drum, although in other examples a photoconductor member 12 may have a different form, such as a continuous belt or any other suitable form. In examples, the photoconductor member may comprise an organic photoconductor (OPC) foil. In operation, the photoconductor member 12 rotates in the direction shown by the arrow.

A charging unit 14 is provided to generate a substantially uniform electrical charge on a surface of the photoconductor member 12. Thus, the charging unit is to charge the photoconductor member to a charged voltage. The charging unit 14 may comprise a corona wire under which the photoconductor member 12 is rotated, or other similar charging system resulting in a uniform static charge over the surface of the photoconductor member 12. In one example the generated electrical charge may result in a charged voltage of about 800 to 1100 V.

As used herein, the term voltage is used to indicate a voltage or potential relative to a reference potential such as ground. Generally the polarity of charging resulting in a corresponding voltage may be negative or positive relative to the reference potential.

An imaging unit 16 is provided to selectively dissipate electrical charge on the photoconductor member 12 by selectively emitting light onto the surface of the photoconductor member 12. In one example, the imaging unit 16 includes at least one laser. The imaging unit selectively dissipates charge in accordance with an image to be printed. Thus, the imaging unit is to generate a latent electrostatic image on the photoconductor member by discharging areas of the charged photoconductor member. The imaging unit thus creates a latent electrostatic image on the surface of the photoconductor member 12, that comprises discharged areas and non-discharged areas that correspond to portions of the image that are to receive toner, and portions of the image that are not to receive toner. It is to be noted that discharging may not be complete, leaving some residual potential in the discharged areas.

A developer unit 18 is provided to electrostatically transfer liquid toner stored within the developer unit 18 to the surface of the photoconductor member 12 in accordance with the latent image thereon. Generally, the non-charged or discharged areas of the photoconductor may receive toner while the charged areas of the photoconductor member may not receive toner. In alternative examples the function of the charged and discharged areas may be reversed. The liquid toner may comprise charge directors. Once an image has been developed on the photoconductor member 12, the image may be electrostatically transferred to an intermediate transfer member 20 for onward transfer, under pressure from an impression roller 22, to a media or substrate 24. In other examples, the image developed on the photoconductor member 12 may be transferred directly to a media without the use of an intermediate transfer member 20.

In some examples a cleaning unit 26 may be provided to remove any traces of toner remaining on the surface of the photoconductor member 12 after transfer of the image to the intermediate transfer member 20 or after direct transfer to the media, as well as to dissipate any residual electrical charges on the surface of the photoconductor member 12.

It should be noted that, depending on the size of the photoconductor member 12 and the size of the image to be printed, a latent image corresponding to just a portion of the image to be printed may be present on the photoconductor member 12 at any one time. In the example shown in FIG. 1, a single developer unit 18 is provided. In other examples a printing system may comprise multiple developer units, for example, one for each of colored toners the printing system is to operate with.

Figure 2:
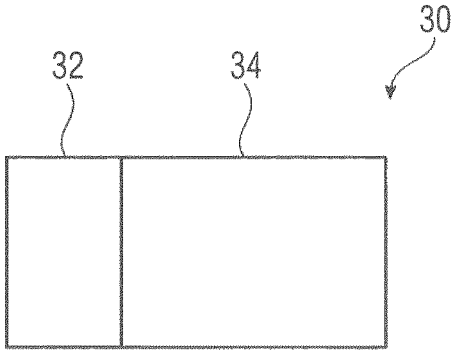
FIG. 2 is a schematic diagram of a controller of the printing system of FIG. 1.

The operation of the printing system is generally controlled by a printer controller 30. As shown in FIG. 2, the printer controller 30 may comprise a processor 32, such as a microprocessor, coupled to a memory 34 through an appropriate communication bus (not shown). The memory 34 may store machine readable instructions and the processor 32 may execute the instructions to cause the printer controller 30 to operate a printing system as described herein.

As described above, in electrostatic printing systems (Xerography systems), an electrical image is created on the photoconductor member, wherein firstly the photoconductive member is charged electrically, wherein the voltage of the charged photoconductor member is called charged voltage, $V_{dark}$ or $V_{background}$. A light source may selectively discharge the photoconductor member in areas creating the latent image on the photoconductor member, wherein the voltage of the discharged photoconductor member may be called $V_{light}$. Since $V_{light}$ of the photoconductor member may be increased with the age of the photoconductor member due to thousands of charge and discharge cycles, $V_{dark}$ may also be increased in order to maintain the same operating window, i.e., the same difference between $V_{dark}$ and $V_{light}$.

The ink, i.e., the liquid toner, is also charged and attracted onto the developer unit 18, such as a developer roller. The developer roller touches that photoconductor member. By changing the developer voltage, the thickness of the ink layer, which is transferred to the photoconductor member, can be controlled. FIG. 3*a* schematically shows different voltages appearing in the printing system. A voltage $V_{ground}$ represents machine ground (generally a voltage of zero). In addition, $V_{light}$ and $V_{dark}$ are shown, wherein the operating window OW between $V_{light}$ and $V_{dark}$ may be 900V. Moreover, a developer voltage range 40 is shown in FIG. 3*a*. In examples, the developer voltage range may be from 280V to 600V above $V_{light}$. A voltage difference between the charged voltage $V_{dark}$ and the developer voltage may be referred to as a cleaning vector CV.

Since ink properties may vary in time due to batch to batch variation or changes in concentration of solids and charging agents, developer voltage also may be changed in order to maintain the same optical density on a substrate in a process called developer voltage calibration (or color calibration since one developer unit may be provided for each color). When the developer voltage is increased, its difference from $V_{dark}$ (cleaning vector CV) is reduced. Examples described herein are based on the realization that this may cause unwanted transfer of ink to areas where it should not. Such an unwanted transfer of ink may cause increased ink consumption and reduction in filter life span and life span of other consumables. It can also cause a reduction in print quality if the unwanted transfer of ink is visible, such as for the naked eye.

Examples described herein are based on the realization that improved printing can be achieved in printing systems in which the controller 30 is to change the developer voltage and to change the charged voltage dependent on the change of the developer voltage. In examples, the photoconductor charging voltage, i.e., the charged voltage or $V_{dark}$, is increased when the developer voltage is increased, instead of maintaining a constant operating window.

The controller may be to change the charged voltage by controlling the charging unit to charge the photoconductor member to the charged voltage. The controller may be to change the developer voltage based on a developer voltage calibration performed to obtain a desired ink layer thickness.

In examples, the charged voltage is controlled to keep the cleaning vector constant. Such an approach is shown in FIGS. 3*b* and 3*c*. FIG. 3*b* shows a first state, in which a first developer voltage $V_{dev1}$ is applied to the developer unit 18 and the photoconductor member 12 is charged to a first charged voltage $V_{dark1}$. In FIG. 3*c*, the developer voltage was increased to a second developer voltage $V_{dev2}$, such as during a developer voltage calibration. In examples described herein, in response to the increase of the developer voltage the charged voltage is also increased to a second charged voltage $V_{dark2}$. Thus, a constant cleaning vector CV may be maintained. At the same time, the discharged voltage $V_{light}$ maintains unchanged so that the difference between the charged voltage and the discharged voltage, i.e., the operating window, is changed. Thus, examples described herein use a dynamic operating window OW.

Generally, the charged voltage may be changed to effectively couple the charged voltage to the developer voltage, such as the developer roller voltage. In examples, the controller may be to change the charged voltage to reduce or compensate for a change in a difference between the developer voltage and the charged voltage in response to the change of the developer voltage.

In examples described herein, the controller may be to change the charged voltage to keep the difference between the developer voltage and the charged voltage constant, as described referring to FIGS. 3*b* and 3*c*. Generally, doing so may be effective in reducing unwanted ink accumulation in non-discharged areas when developer voltage increases and also in controlling dot gain.

In examples, the charged voltage may be changed differently depending on whether the developer voltage is above or below one or more developer voltage thresholds.

In examples, the controller or the method may be to change the charged voltage to at least one of:

a) keep the charged voltage ($V_{dark}$) constant if the developer voltage ($V_{dev}$) is below a first developer voltage threshold and to increase the charged voltage ($V_{dark}$) if the developer voltage ($V_{dev}$) is above the first developer voltage threshold, b) increase the charged voltage ($V_{dark}$) if the developer voltage is below a second developer voltage threshold and keep the charged voltage ($V_{dark}$) constant if the second developer voltage is above the second developer voltage threshold, c) increase the charged voltage ($V_{dark}$) at a first rate if the developer voltage ($V_{dev}$) is below the first developer voltage threshold and to increase the charged voltage ($V_{dark}$) at a second rate higher than the first rate if the developer voltage ($V_{dev}$) is above the first developer voltage threshold, or d) increase the charged voltage ($V_{dark}$) at a first rate if the developer voltage ($V_{dev}$) is below the second developer voltage threshold and to increase the charged voltage at a second rate lower than the first rate if the developer voltage ($V_{dev}$) is above the second developer voltage threshold.

In examples, the function may be optimized for background reduction. In such examples, the charged voltage may be kept constant if the developer voltage is lower than a first developer voltage threshold and may be increased if the developer voltage is equal to or exceeds the first developer voltage threshold. Thus, increasing of $V_{dark}$ may start at a high developer voltage only. An example for such a function over the developer voltage range x-y is shown in FIG. 4. The charged voltage $V_{dark}$ is kept constant until the developer voltage $V_{dev}$ reaches and exceeds the first developer voltage threshold th1. In examples, if $V_{dev}$<th1, the charged voltage $V_{dark}$ may be kept constant, and if $V_{dev}$≥th1, the cleaning vector may be kept constant. In other examples different rates of changing $V_{dark}$ depending on the value of $V_{dev}$ may be used. For example, the charged voltage may be increased at a first rate if the developer voltage is below the first developer voltage threshold and may be increased at a second rate higher than the first rate if the developer voltage is above the first developer voltage threshold.

In examples, the function may be optimized for dot gain stabilization. In such examples, the charged voltage $V_{dark}$ is increased as $V_{dev}$ is increased over the whole developer voltage range. The increasing rate of $V_{dark}$ may be higher than the increasing rate of $V_{dev}$ so that the cleaning vector increases as $V_{dev}$ increases and the cleaning vector decreases as $V_{dev}$ decreases, i.e. the gradient of the function is greater than one. An example for such a function is shown in FIG. 5. In such examples, which are optimized for dot gain and not for background, the charged voltage $V_{dark}$ may be lower when compared to a regular charged voltage, i.e. the charged voltage in approaches in which the operating window is kept constant.

In examples, the controller may provide a user the possibility to select between different functions, such as those described above. In examples, a user interface may be provided to give the user the possibility to select one of a plurality of functions.

In other examples, the charged voltage $V_{dark}$ may be increased linearly with the developer voltage from the lower boundary x to a second developer voltage threshold and is held constant from the developer voltage threshold to the upper boundary y of the developer voltage. The second developer voltage threshold may be identical or different from the first developer voltage threshold. Such a function may be provided to prevent electrical breakdown of the photoconductor member. In other examples different rates of changing $V_{dark}$ depending on the value of $V_{dev}$ may be used. For example, the charged voltage may be increased at a first rate if the developer voltage is below the second developer voltage threshold and may be increased at a second rate lower than the first rate if the developer voltage is above the second developer voltage threshold.

In other examples, there may be more than one developer voltage threshold. For example, there may be different first and second developer voltage thresholds and the charged voltage may be kept constant until the developer voltage reaches the first developer voltage threshold, may be increased between the first developer voltage threshold and the second developer voltage, and may be kept constant if the developer voltage exceeds the second developer voltage threshold.

Generally, based on the piece-wise continuous functions of the above examples, representative functions may be selected, such as smooth functions having well-defined derivatives.

In examples, the maximum developer voltage, i.e. the upper boundary of the developer voltage range may be increased when compared to the maximum developer voltage used if not changing the charged voltage dependent on the developer voltage. For example, the maximum developer voltage may be increased by 50V to 650V and such an increase may result in an increase of the charged voltage by 100V (such as to 1000V). Thus, in examples, the operating window for the developer voltage may be increased without suffering from increased background.

In examples described herein, the controller may be to perform a developer voltage calibration in order to calibrate ink layer thickness. During the developer voltage calibration, the developer voltage may be changed to obtain a desired ink layer thickness. This calibration may be performed by printing the various developer voltages and measuring the ink layer thickness on the substrate by measuring light scattered from the ink layer with an appropriate device, such as a densitometer. Such a densitometer may be integrated in the printing system. As previously mentioned, since the developer voltage may increase due to a variation in ink properties, unwanted transfer of ink to the media may also be increased. This may to lead to higher ink consumption, reduction in consumables lifespan and reduction in print quality. Another byproduct of developer increment is an increment of the dot gain. Examples described herein are effective to counteract such effects by increasing the charged voltage when the developer voltage is increased in order to maintain low background on the media. In addition, since increasing the charged voltage on the one hand and the developer voltage on the other hand have opposite effects on dot gain, dot gain can also be stabilized.

Thus, examples described herein provide a dynamic charging of the photoconductor to different charged voltages dependent on the developer voltage. Many functions of dynamic charging can be used in order to reduce the background on the media, wherein one example is a constant cleaning vector. Another possibility to reduce background on the media maybe by an iterative process, in which photoconductor charging is increased until a desired background level on the substrate is achieved. In examples described herein, the controller may be to determine a background level upon printing on a substrate after changing the developer voltage and to change the charged voltage if the background level exceeds a background level threshold and not to change the charged voltage if the background level does not exceed the background level threshold. Background levels may be measured as input to the controller, for example, by an image scanning device integrated in the printer. Such a process may be implemented in an iterative manner, wherein the controller is to iteratively change the charged voltage and to determine the background level in response to each iteration until the background level no longer exceeds the background level threshold.

In examples described herein, the controller may be to determine dot gain upon printing on a substrate after changing the charged voltage and to further change the charged voltage if the dot gain is above a first dot gain threshold or to partly reverse change of the charged voltage if the dot gain is below a second dot gain threshold. Thus, examples may be effective to compensate for effects on the dot area effected by increasing the developer voltage by dynamically changing the charged voltage in an iterative manner.

Example operations of the printing system will now be described by way of examples only, with reference to the flow diagrams of FIGS. 4 to 6.

At 402 in FIG. 6, the developer voltage is changed by the printer controller 30. At 404, the charged voltage is changed by the printer controller 30 dependent on the change of the developer voltage. The charged voltage may be changed according to a predefined function of the developer voltage. In an example, the charged voltage is changed to keep the difference between the charged voltage and the developer voltage constant. In other examples, a proportionality between the developer voltage and the charged voltage may be used so that a change in a difference between the developer voltage and the charged voltage due to the change of the developer voltage is reduced or compensated. For example, the predefined function may be stored within memory 34. Examples for functions are described above referring to FIGS. 4 and 5.

An example operation of the printing system using calibration of ink layer thickness is shown in FIG. 7. At 502, ink layer thickness is calibrated by the controller 30 via the developer voltage, i.e., the developer voltage is changed (increased) in order to obtain a desired ink layer thickness. At 504, the charged voltage is changed dependent on the developer voltage. Again, the charged voltage may be changed according to a predefined function of the developer voltage. At 506, dot gain upon printing on a substrate after changing the charged voltage is measured. Dot gain may be measured from a comparison of a measured dot area of a printed dot and a digital dot area, i.e., the area of the original digital source dot. The area of the original digital source dot may be stored in a look up table (LUT). At 508, the charged voltage is further (increasingly) changed if the dot gain is above a first dot gain threshold. Otherwise, if the dot gain is below a second dot gain threshold, change of the charged voltage is partly reversed. The first dot gain and the second dot gain define a range of acceptable dot gains, wherein the second dot gain is lower than the first dot gain.

504 to 508 may be repeated in an iterative manner so that a desired dot gain may be achieved.

The concept of FIG. 7 may be conducted during a dot gain calibration process during which dot gain may be measured and corrected for. Thus, the function may be defined based on a dot gain target value/range. In examples, the function defining how the charged voltage is changed dependent on the developer voltage does not need to be predefined but may be determined during a calibration process. The controller of the printing system may be to conduct such a calibration process periodically.

FIG. 8 shows another example operation of the printing system. At 602, the ink layer thickness is calibrated via the developer voltage. Printing on a substrate takes place using the developer voltage obtained at 602. The background level is determined upon printing and at 604 it is determined whether the background level is larger than a background level threshold, such as a maximum allowed background level threshold. If the background level is not above the background level threshold, the process ends at 606. If the background level is above the background level threshold, determination whether the charged voltage is below a charged voltage threshold, such as a maximum allowed charged voltage, takes place at 608. If the charged voltage is not lower than the charged voltage threshold, the process ends at 606. If the charged voltage is lower than the charged voltage threshold, the charged voltage is increased at 610. 604, 608 and 610 may be repeated in an iterative manner as indicated by arrow 612 until the background level is below the background level threshold or until the charged voltage reaches the charged voltage threshold.

Thus, examples described herein may be effective to achieve background on substrate reduction and/or stabilized dot gain by using dynamic charging of a photoconductor in electro-photography by dynamically charging the photoconductor dependent on the developer voltage. Ink property variations from day to day and batch to batch may be compensated while ink consumption may be reduced, consumable lifespan may be increased and variations in dot gain may be reduced.

Generally, dot gain in terms of the measured dot area versus the digital dot area increases without $V_{dark}$ calibration, i.e., without changing the charged voltage dependent on the developer voltage. Generally, such an increment of dot gain may be compensated via laser power modification and/or a modification (within the imaging unit 16) and/or a modification of a dot gain lookup table (LUT), which may be stored within memory 34. However, if the dot gain is too high, it may no longer be possible to reduce the dot gain in this manner without affecting the print quality. Examples described herein permit reducing or compensating for dot gain variation due to ink charging variations/developer voltage variations by changing the charged voltage dependent on the developer voltage. This may be achieved even in cases in which reduction of dot gain via laser power modification and/or dot gain lookup table modifications would result in print quality issues.

Examples described herein permit reduction of the background level by changing the charged voltage dependent on the developer voltage. In examples, by using a dynamic operating window the unwanted transfer of ink can be reduced when the developer voltage is high. This may be achieved without having to rebuild aged ink into fresh ink. Thus, costs may be reduced and machine utilization may be increased. Accordingly, higher print quality, lower cost of ink consumption, higher consumable lifespan and higher utilization (less ink, filters and consumables replacements) may be achieved.

Examples may provide a tradeoff between dot gain control and background reductions such as by using a cleaning vector optimized over the developer voltage range.

In examples described herein, the voltages used may be positive voltages and in other examples, the voltages may be negative voltages. In examples, the developer voltage that is applied to the developer unit can be generated with any of several developer voltages which can be adjusted to control a printing process. The several developer voltages can include a roller voltage, a squeegee voltage, an electrode voltage, a cleaning roller voltage, and/or any combination of these and other associated developer unit voltages. In examples, the roller voltage may be calibrated while one or all of the other developer voltages, such as the electrode voltage, are not calibrated.

In examples, methods described herein comprise determining a background level upon printing on a substrate after changing the developer voltage, changing the charged voltage if the background level exceeds a background level threshold and not changing the charged voltage if the background level does not exceed the background level threshold.

In examples, methods described herein comprise iteratively changing the charged voltage and determining the background level after each iteration until the background level no longer exceeds the background level threshold.

In examples, methods described herein comprise determining a dot gain upon printing on a substrate after changing the charged voltage; and increasingly changing the charged voltage if the dot gain is above a first dot gain threshold or partly reversing change of the charged voltage if the dot gain is below a second dot gain threshold.

Examples relate to a non-transitory machine-readable storage medium encoded with instructions executable by a processing resource of a computing device to perform methods described herein.

Examples relate to a non-transitory machine-readable storage medium encoded with instructions executable by a processing resource of a computing device to operate an electrostatic printing system. The electrostatic printing system comprises a charging unit to charge the photoconductor member to a charged voltage, an imaging unit to generate a latent electrostatic image on the photoconductor member by discharging areas of the charged photoconductor member and a developer unit to develop a toner image on the photoconductor member using a developer voltage. The electrostatic printing system may be operated to perform a method, the method comprising: changing the developer voltage, and changing the charged voltage dependent on the change of the developer voltage.

It will be appreciated that examples described herein can be realized in the form of hardware, machine readable instructions or a combination of hardware and machine readable instructions. Any such machine readable instructions may be stored in the form of volatile or non-volatile storage such as, for example, a storage device like a ROM, whether erasable or rewriteable or not, or in the form of memory such as, for example, RAM, memory chips, device or integrated circuits or an optically or magnetically readable medium such as, for example, a CD, DVD, magnetic disk or magnetic tape. It will be appreciated that the storage devices and storage media are examples of machine-readable storage that are suitable for storing a program or programs that, when executed, implement examples described herein.

All of the features disclosed in the specification (including any accompanying claims, abstract and drawings), and/or all the features of any method or progress disclosed may be combined in any combination, except combinations where at least some of such features are mutually exclusive. In addition, features disclosed in connection with a system may, at the same time, present features of a corresponding method, and vice versa.

Each feature disclosed in the specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention claimed is:

1. An electrostatic printer comprising:
a photoconductor member;
a charging unit to charge the photoconductor member to a charged voltage;
an imaging unit to generate a latent electrostatic image on the photoconductor member by discharging areas of the charged photoconductor member;
a developer unit to develop a toner image on the photoconductor member using a developer voltage; and
a controller to:
change the developer voltage; and
change the charged voltage dependent on the change of the developer voltage to reduce or compensate for a change in a difference between the charged voltage and the developer voltage in response to the change of the developer voltage.

2. The electrostatic printer of claim 1, wherein the controller is to determine a dot gain upon printing on a substrate after changing the charged voltage and to increasingly change the charged voltage if the dot gain is above a first dot gain threshold or to partly reverse change of the charged voltage if the dot gain is below a second dot gain threshold.

3. An electrostatic printer comprising:
a photoconductor member;
a charging unit to charge the photoconductor member to a charged voltage;
an imaging unit to generate a latent electrostatic image on the photoconductor member by discharging areas of the charged photoconductor member;
a developer unit to develop a toner image on the photoconductor member using a developer voltage; and
a controller to:
change the developer voltage; and
change the charged voltage dependent on the change of the developer voltage to keep the difference between the developer voltage and the charged voltage constant.

4. An electrostatic printer comprising:
a photoconductor member;
a charging unit to charge the photoconductor member to a charged voltage;
an imaging unit to generate a latent electrostatic image on the photoconductor member by discharging areas of the charged photoconductor member;
a developer unit to develop a toner image on the photoconductor member using a developer voltage; and
a controller to:
change the developer voltage; and
change the charged voltage dependent on the change of the developer voltage, wherein the controller is to change the charged voltage differently depending on whether the developer voltage is above or below one or more developer voltage thresholds.

5. The electrostatic printer of claim 4, wherein the controller is to at least one of
a) keep the charged voltage constant if the developer voltage is below a first developer voltage threshold and to increase the charged voltage if the developer voltage is above the first developer voltage threshold,
b) increase the charged voltage if the developer voltage is below a second developer voltage threshold and keep the charged voltage constant if the developer voltage is above the second developer voltage threshold,
c) increase the charged voltage at a first rate if the developer voltage is below the first developer voltage threshold and to increase the charged voltage at a second rate higher than the first rate if the developer voltage is above the first developer voltage threshold, or
d) increase the charged voltage at a first rate if the developer voltage is below the second developer voltage threshold and to increase the charged voltage at a second rate lower than the first rate if the developer voltage is above the second developer voltage threshold.

6. The electrostatic printer of claim 4, wherein the controller is to at least one of increase the difference between the charged voltage and the developer voltage if the developer voltage is increased or decrease the difference between the charged voltage and the developer voltage if the developer voltage is decreased.

7. An electrostatic printer comprising:
a photoconductor member;
a charging unit to charge the photoconductor member to a charged voltage;
an imaging unit to generate a latent electrostatic image on the photoconductor member by discharging areas of the charged photoconductor member;
a developer unit to develop a toner image on the photoconductor member using a developer voltage; and
a controller to:
change the developer voltage; and
change the charged voltage dependent on the change of the developer voltage wherein the controller is to determine a background level upon printing on a substrate after changing the developer voltage and to change the charged voltage if the background level exceeds a background level threshold and not to change the charged voltage if the background level does not exceed the background level threshold.

8. The electrostatic printer of claim 7, wherein the controller is to iteratively change the charged voltage and to determine the background level in response to each iteration until the background level no longer exceeds the background level threshold.

9. A method of operating an electrostatic printing system comprising a charging unit to charge a photoconductor member to a charged voltage, an imaging unit to generate a latent electrostatic image on the photoconductor member by discharging areas of the charged photoconductor member and a developer unit to develop a toner image on the photoconductor member using a developer voltage, the method comprising:

changing the developer voltage; and changing the charged voltage dependent on the change of the developer voltage wherein changing the charged voltage comprises at least one of:

changing the charged voltage to keep the difference between the developer voltage and the charged voltage constant;

changing the charged voltage differently depending on whether the developer voltage is above or below one or more developer voltage thresholds; or increasing the difference between the charged voltage and the developer voltage if the developer voltage is increased or decreasing the difference between the charged voltage and the developer voltage if the developer voltage is decreased.

10. The method of claim 9, wherein changing the charged voltage comprises changing the charged voltage to keep the difference between the developer voltage and the charged voltage constant.

11. The method of claim 9, wherein changing the charged voltage comprises changing the charged voltage differently depending on whether the developer voltage is above or below one or more developer voltage thresholds.

12. The method of claim 11, wherein changing the charged voltage comprises at least one of:

a) keeping the charged voltage constant if the developer voltage is below a first developer voltage threshold and increasing the charged voltage if the developer voltage is above the first developer voltage threshold, b) increasing the charged voltage if the developer voltage is below a second developer voltage threshold and keeping the charged voltage constant if the developer voltage is above the second developer voltage threshold, c) increasing the charged voltage at a first rate if the developer voltage is below the first developer voltage threshold and increasing the charged voltage at a second rate higher than the first rate if the developer voltage is above the first developer voltage threshold, or d) increasing the charged voltage at a first rate if the developer voltage is below the second developer voltage threshold and increasing the charged voltage at a second rate lower than the first rate if the developer voltage is above the second developer voltage threshold.

13. The method of claim 9, wherein changing the charged voltage comprises at least one of increasing the difference between the charged voltage and the developer voltage if the developer voltage is increased or decreasing the difference between the charged voltage and the developer voltage if the developer voltage is decreased.

14. A non-transitory machine-readable storage medium encoded with instructions executable by a processing resource of a computing device to operate an electrostatic printing system comprising a charging unit to charge the photoconductor member to a charged voltage, an imaging unit to generate a latent electrostatic image on the photoconductor member by discharging areas of the charged photoconductor member and a developer unit to develop a toner image on the photoconductor member using a developer voltage to perform a method, the method comprising:

changing the developer voltage; and changing the charged voltage dependent on the change of the developer voltage to at least one of:

reduce or compensate for a change in a difference between the charged voltage and the developer voltage in response to the change of the developer voltage; or keep the difference between the developer voltage and the charged voltage constant.

15. The medium of claim 14, wherein changing the charged voltage dependent on the change of the developer voltage comprises changing the charged voltage dependent on the change of the developer voltage to reduce or compensate for a change in a difference between the charged voltage and the developer voltage in response to the change of the developer voltage.

16. The medium of claim 14, wherein changing the charged voltage dependent on the change of the developer voltage comprises changing the charged voltage dependent on the change of the developer voltage to keep the difference between the developer voltage and the charged voltage constant.

* * * * *